US005192824A

United States Patent [19]

Shibukawa

[11] Patent Number: 5,192,824

[45] Date of Patent: Mar. 9, 1993

[54] ELECTRONIC MUSICAL INSTRUMENT HAVING MULTIPLE OPERATION MODES

[75] Inventor: Takeo Shibukawa, Hamamatsu, Japan

[73] Assignee: Yamaha Corporation, Hamamatsu, Japan

[21] Appl. No.: 631,475

[22] Filed: Dec. 20, 1990

[30] Foreign Application Priority Data

Dec. 21, 1989 [JP] Japan ..... 1-331882

[51] Int. Cl.[5] ..... G10H 1/00; G10H 1/06; G10H 7/00

[52] U.S. Cl. ..... 84/615; 84/DIG. 1; 84/DIG. 2; 84/DIG. 20; 84/DIG. 27; 84/625; 84/660; 84/697

[58] Field of Search ..... 84/DIG. 20, DIG. 27, 84/615, 616, 625, 660, 653, DIG. 1, 626, 692, 698, 478, DIG. 2

[56] References Cited

U.S. PATENT DOCUMENTS

| | | | |
|---|---|---|---|
| 4,282,787 | 8/1981 | Walborn | 84/DIG. 20 |
| 4,373,415 | 2/1983 | Kondo | 84/DIG. 2 |
| 4,384,506 | 5/1983 | Amano et al. | 84/DIG. 2 |
| 4,685,134 | 8/1987 | Wine | 84/DIG. 1 |
| 4,711,148 | 12/1987 | Takeda et al. | 84/478 |
| 4,773,294 | 9/1988 | Tizuka et al. | 84/615 |
| 4,909,116 | 3/1990 | Tanaka et al. | 84/692 |
| 4,972,753 | 11/1990 | Adachi et al. | 84/626 |

FOREIGN PATENT DOCUMENTS

| | | |
|---|---|---|
| 57-195195 | 12/1982 | Japan . |
| 59-166293 | 11/1984 | Japan . |
| 61-97698 | 5/1986 | Japan . |

*Primary Examiner*—William M. Shoop, Jr.
*Assistant Examiner*—Helen Kim
*Attorney, Agent, or Firm*—Spensley Horn Jubas & Lubitz

[57] ABSTRACT

An electronic musical instrument having selectable monaural, stereo and multiple channel musical performance capability is disclosed which includes a performance data generating device; tone signal generating systems; sound producing systems; a mode indicating device; a selection device; and a distribution device. The tone signal generating systems generate musical tone signals based on performance data generated by the performance data generating device. The sound producing systems produce musical sounds based based on the musical tone signals. The selection device allocates performance data to a single musical tone signal generating system when the mode indicated by the mode indicating device is the first mode. The selection device allocates performance data to plural musical tone generating systems when the mode indicated by the mode indicating means is the second mode. The distribution device supplies to one or more musical sound producing systems the musical tone signal output from the single musical tone generating system when the mode indicated by the mode indicating device is the first mode. The distribution device supplies to at least two musical sound producing systems the musical tone signals output from the respective musical tone generating systems when the mode indicated by the mode indicating device is the second mode.

25 Claims, 7 Drawing Sheets

ELECTRONIC MUSICAL INSTRUMENT HAVING MULTIPLE OPERATION MODES

BACKGROUND OF THE INVENTION

1. Field of the Invention

The present invention relates to electronic musical instruments, and in particular, to electronic musical instruments which employ multiple tone generating elements.

2. Prior Art

Sound production by a speaker can generally be considered in terms of sound radiating from a single point and having significant directional properties, whereas in the case of conventional non-electronic musical instruments, the sound produced thereby most often emanates from a three dimensional cavity and/or from one or more two dimensional surfaces with variable directional properties. For example, in the case of a piano, through the action of hammers on strings, a considerably broad sound board is caused to vibrate from which sound radiates in a relatively diffuse pattern. Electronic musical instruments have been conventionally disclosed whereby the effect of a conventional non-electronic musical instrument can be simulated, that is, the effect of sound radiating from a two or three dimensional source having the directional properties of the target instrument is simulated. Examples of this type of electronic musical instrument include that disclosed in Japanese Patent Publication Laid-Open No. Sho61-97698. Waveform data for this kind of device are obtained by producing musical tones using a conventional musical instrument which is to be simulated within an acoustical environment to be simulated, and capturing the produced tones with multiple acoustical sensors spatially distributed at varying distances and positions in relation to the conventional musical instrument. The acoustical data thus obtained from each acoustical sensor is converted to waveform data which is then stored using a suitable memory device or data storage media. By simultaneously reading out the waveform data thus stored and reproducing the sound using multiple speakers suitably arranged, the sound originally produced using the conventional musical instrument can be quite faithfully reproduced.

In Japanese Utility Model Publication Laid-Open No. Sho59-166293, another electronic musical instrument has been disclosed, employing multiple musical tone generating systems operated in parallel, as with the device described above. With this device as well, plural waveform data is stored in multiple memory devices, from which the waveform data is simultaneously read out at a predetermined rate, whereupon signals based thereon are supplied to two or more speakers, whereby the sound of a conventional musical instrument is reproduced.

With the type of conventional devices described above, multiple tone generating and sound producing systems are employed and operated in parallel. Certain situations exist, however, when it is desirable to use only a single tone generating and sound producing system, for example when monaural sound reproduction is desired. The conventional electronic musical instruments described above generally do not permit a single tone generating and sound producing system to be used alone, for which reason these devices are suboptimal in such a case.

Further, to provide capability for monaural sound reproduction, as well as for stereo sound reproduction, or for three or more channel sound reproduction in one device, and to provide the output of each tone generating system to variable number of sound producing systems, a tone generator for monaural sound production and an additional tone generator for multichannel sound reproduction are required, thereby complicating the design and electronic layout of the device.

SUMMARY OF THE INVENTION

In consideration of the above described limitations inherent to these conventional devices, it is an object of the present invention to provide an electronic musical instrument having a simplified design, wherein one or more sound producing systems can be individually or multiply selected with ease, thereby contemporaneously providing freely selectable monaural, stereo and multiple channel musical performance capability in a single device.

In order to achieve the above described capabilities, one embodiment of the present invention provides an electronic musical instrument comprising:

a) performance data generating means for generating performance data corresponding to a musical performance;

b) multiple musical tone generating systems for producing musical tone signals in response to the above mentioned performance data;

c) multiple musical sound producing systems to which the above mentioned musical tone signals are supplied and which produce musical sound in response to the supplied musical tone signals;

d) mode indicating means for indicating either:

i) a first mode wherein musical sound is generated in response to operation of one musical tone generating system, or ii) a second mode wherein musical sound is generated in response to operation of two or more musical tone generating systems;

e) selection means for:

i) allocating the performance data output from the performance data generating means to a single musical tone generating system when the mode indicated by the mode indicating means is the above mentioned first mode, or ii) allocating the performance data output from the performance data generating means to each of the multiple musical tone generating systems when the mode indicated by the mode indicating means is the above mentioned second mode;

f) distribution means for either:

i) supplying to one or more musical sound producing systems the musical tone signal output from the single musical tone generating system to which performance data is allocated when the mode indicated by the mode indicating means is the first mode, or ii) supplying to each musical sound producing system the musical tone signal output from a respective musical tone generating system when the mode indicated by the mode indicating means is the second mode, such that each musical tone signal is supplied to a different musical sound producing system.

With the electronic musical instrument of the present invention implemented as described above, when the first mode is selected, musical sound is generated by multiple musical sound producing systems through the operation of one musical tone generating system, for which reason monaural musical sound is produced. When the second mode is selected, musical sound is generated by multiple musical sound producing systems through the operation of two or more musical tone generating systems, for which reason stereo (two channel) musical sound, as well as three channel and greater than three channel musical sound can be produced.

Again, so as to achieve the object of the present invention as previously described, another aspect of this invention provides an electronic musical instrument comprising:

g) performance data generating means for generating performance data, in response to which, the generation of musical sound is effected;

h) tone data memory means for storing multiple tone data representing waveforms corresponding to musical tones;

i) multiple musical tone signal generating systems to which tone data and performance data are supplied, in response to which, the musical tone signal generating systems produce musical tone signals;

j) mode indicating means for indicating either:

i) a first mode wherein musical sound is generated in response to one musical tone datum, or ii) a second mode wherein musical sound is generated in response to two or more musical tone data;

k) control means for allocating the performance data output from the above mentioned performance data generating means to each of the musical tone signal generating systems, and for:

i) allocating a single musical tone datum out of the above mentioned multiple tone data to all of the musical tone signal generating systems when the mode indicated by the mode indicating means is the above mentioned first mode, or ii) allocating each musical tone datum to a respective musical tone signal generating systems when the mode indicated by the mode indicating means is the second mode, such that each musical tone datum is allocated to a different musical tone signal generating system.

With the electronic musical instrument of the above described aspect of the present invention, when the first mode is selected, a musical tone signal is generated through the operation of multiple musical tone signal generating systems based on the tone data stored in a single tone data memory means, for which reason monaural musical sound is produced. When the second mode is selected, in response to tone data stored in multiple unique tone data memory means, musical tone signals are generated through the operation of multiple musical tone signal generating systems, whereby it becomes possible to produce stereo musical sound, as well as three channel and greater than three channel musical sound.

DETAILED DESCRIPTION OF THE PREFERRED EMBODIMENTS

In the following, a first preferred embodiment of the present invention will be described with reference to the drawings.

Figure 1:
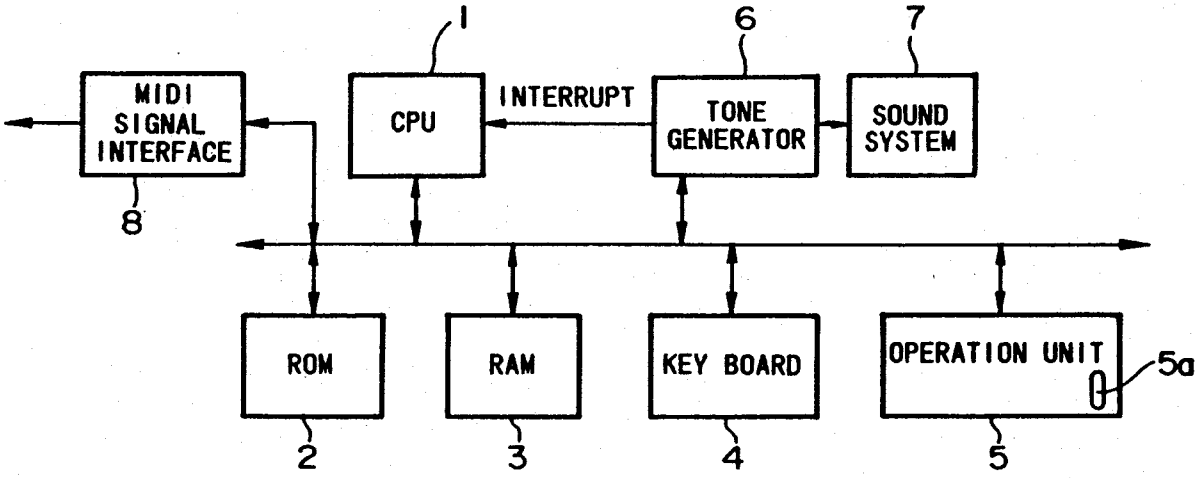
FIG. 1 is a block diagram illustrating the general layout of the electronic musical instrument of a first preferred embodiment of the present invention.

First of all, the structure of the musical instrument of this first preferred embodiment will be described. Referring to FIG. 1, a block diagram illustrating the general layout of the device is presented. In the diagram, a CPU 1 can be seen, whereby based on a control program stored in ROM 2, the overall operation of the illustrated device is controlled. RAM 3 forms a work memory area, wherein various types of data are temporarily stored. Keyboard 4 consists of multiple keys, the output of which includes key-codes KC whereby it is possible to distinguish between the operation of individual keys, as well as other signals including key-on and key-off signals which indicate depression and release of keys, respectively. Operation unit 5 includes a stereo switch 5*a* whereby it is possible to designate monaural or stereo operation, as well as other switches not shown in the drawing such timbre selection switches for designating various timbres.

Figure 2:
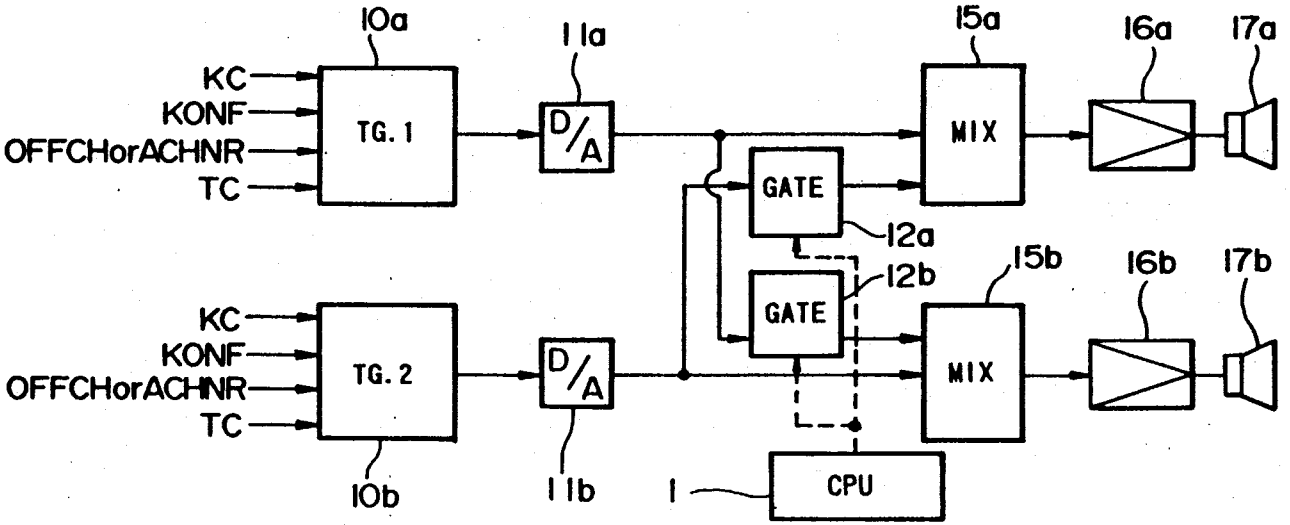
FIG. 2 is a block diagram illustrating the layout of tone generation and sound systems employed in the electronic musical instrument shown in FIG. 1.

Tone generation unit 6 includes two tone generators, tone generator 10*a* and tone generator 10*b*, as is shown in FIG. 2. In the case of stereo operation, a right channel musical tone signal and left channel musical tone signal are simultaneously output from tone generation unit 6, the right channel musical tone signal arising in one of tone generators 10*a* and 10*b* and the left channel musical tone signal arising in the other. As is shown in FIG. 2, in response to key-codes KC, timber signals TC and the like, musical tone signals are output from tone generators 10*a* and 10*b*. Up to eight musical parts can be multiplexed on each musical tone signal.

Referring again to FIG. 1, a sound system 7 can be seen which is in turn made up of D/A converters 11*a*, 11*b*, gates 12*a*, 12*b*, mixers 15*a*, 15*b*, amplifiers 16*a* and 16*b* and speakers 17*a*, 17*b*, as is shown in FIG. 2. In D/A converters 11*a*, 11*b*, digital waveform data supplied from tone generators 10*a*, 10*b*, respectively, are converted to corresponding analog signals. The output signals from each D/A converter 11*a*, 11*b*, is supplied to an input terminal of a respective homolateral mixer 15*a*, 15*b* and contralateral gate 12*b*, 12*a*, respectively. The output signal from each gate 12*a*, 12*b* is supplied to an input terminal of the corresponding homolateral mixer 15*a*, 15*b*, respectively. Each mixer 15*a*, 15*b* has two input terminals. The signal supplied to one of the input terminals of each from its homolateral D/A converter 11*a*, 11*b* and the signal supplied to the other input terminal of each from its contralateral gate 12*a*, 12*b* are mixed within each respective mixer 15*a*, 15*b*. The output signal from each mixer 15*a*, 15*b* is supplied to a respective amplifier 16*a*, 16*b* from which the output signals thereof are supplied to respective speakers 17*a*, 17*b*. Gates 12*a*, 12*b* are capable of opening and closing based on respective control signals supplied thereto from CPU 1.

With the electronic musical instrument thus described, speaker 17*a* is situated on the right with respect to a listener facing the system, and speaker 17*b* is situated on the left. It can thus be seen that tone generator 10*a* corresponds to the right channel and tone generator 10*b* corresponds to the left channel, from the point of view of an individual facing the system.

Next, the operation of the electronic musical instrument of this first preferred embodiment of the present invention will be described with reference to the flow charts shown in FIGS. 3 through 10.

I. Main Routine

Figure 3:
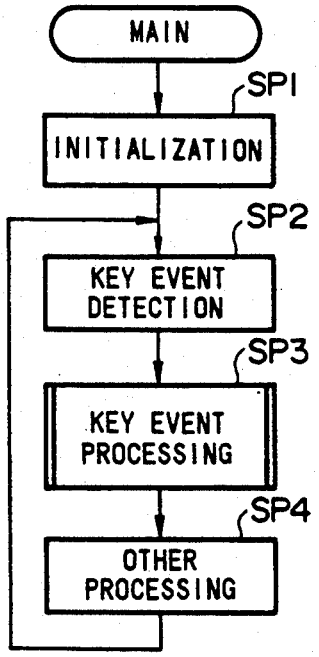
FIG. 3 through 10 are flow charts illustrating the operation of the electronic musical instrument shown in FIG. 1.

FIG. 3 is a flow chart illustrating the operation of the main routine executed in CPU 1 in the electronic musical instrument of the present embodiment. In the flow chart, step SP1 represents initialization processing. In step SPl, each register in CPU 1 is set to an initial value. The principle registers employed in the electronic musical instrument of the present embodiment include:

Register ACHNR1: Register ACHNR1 is a data area which holds the number of a signal channel for the right main channel, that is, for tone generator 10*a*, which has not yet been utilized. When all of the available channels have been employed on the right, the number of the least recently employed signal channel for the right main channel, hereafter referred to as signal channel LRER, is stored in register ACHNR1.

Register ACHNR2: Register ACHNR2 is a data area which holds the number of a signal channel for the left main channel, that is, for tone generator 10*b*, which has not yet been utilized. When all of the available channels have been employed on the left, the number of the least recently employed signal channel for the left main channel, hereafter referred to as signal channel LREL, is stored in register ACHNR2.

Registers CHSR1-1 through CHSR1-8: Each of registers CHSR1-1 through CHSR1-8 is a data area corresponding to one of the eight tone channels for the right main channel, to each of which a value is written indicating the relative priority ranking of the corresponding tone channel. This will be described in greater detail when tone channel priority processing is discussed in a following section. When specification is not necessary, any of the eight registers will be referred to generically as CHSR1 in following sections.

Registers CHSR2-1 through CHSR2-8: Each of registers CHSR2-1 through CHSR2-8 is a data area corresponding to one of the eight tone channels for the left main channel, to each of which a value is written indicating the relative priority ranking of the corresponding tone channel. When specification is not necessary, any of the eight registers will be referred to generically as CHSR2 in the following sections.

Registers KCR1-1 through KCR1-8 Each of registers KCR1-1 through KCR1-8 is a data area corresponding to one of the eight tone channels for the right main channel, to each of which a key-code KC indicating a key on keyboard 4 which has been depressed is stored, when the key-code KC has been allocated to that channel. During key-off event processing, these registers are searched so as to determine what channel the key to which the key-off event processing corresponds to was previously allocated for that key.

Registers KCR2-1 through KCR2-8: Each of registers KCR2-1 through KCR2-8 is a data area corresponding to one of the eight tone channels for the left main channel, to each of which a key-code KC indicating a key on keyboard 4 which has been depressed is stored, when the key-code KC has been allocated to that channel. During key-off event processing, these registers are searched so as to determine what channel the key to which the key-off event processing corresponds to was previously allocated for that key.

Referring again to FIG. 3, during the initialization processing in step SP1, registers ACHNR1 and ACHNR2 are each cleared, and all of the other registers are set to 1.

Having completed step SP1, the main routine then proceeds to step SP2, wherein key event detection processing is carried out. During this processing, among each of the keys on keyboard 4, if any on-event which corresponds to a key being depressed, or off-event which corresponds to a depressed key being released occurs, a key-on signal or key-off signal, respectively, along with the key-code corresponding to that key is issued. After completion of the processing in step SP2, the main routine proceeds to step SP3, wherein key event processing is carried out. During this processing, the routine jumps to the routine shown in the flow chart of FIG. 4, wherein key event processing for the specific key to which the event corresponds is carried out. After the completion of key event processing, the execution proceeds to step SP4 of the main routine, where other additional processing is carried out, for example, timbre designation in response to operation of switches on control unit 5. Once the processing in step SP4 is completed, the main routine returns to step SP2, after which the above described succession of steps repeats.

II. Key Event Processing Routine

Figure 4:
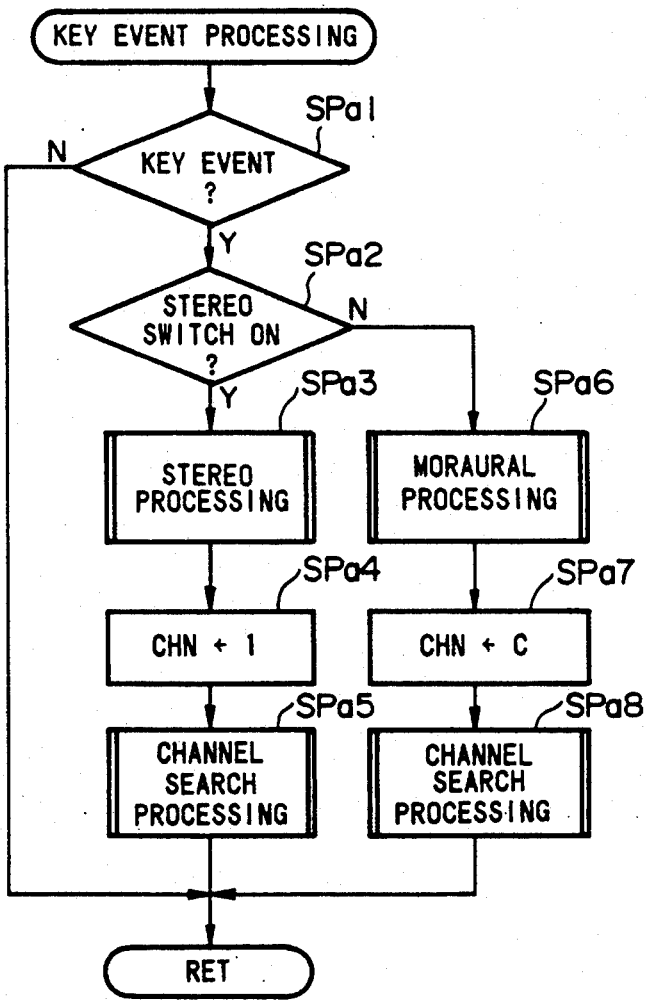

In the following, the above mentioned key event processing routine shown in the flow chart of FIG. 4 will be described.

First of all, in step SPa1, judgement is made as to whether a key event has occurred or not. When the result of this judgement is [NO], processing returns to the main routine, whereas when the result is [YES], the routine proceeds to step SPa2. In step SPa2, judgement is made as to whether switch 5*a* on control unit 5 is on or not. When the result of this judgement is [YES], the routine proceeds to step SPa3, whereby a stereo processing routine is carried out, whereas when the result is [NO], processing jumps to step SPa6, whereby a monaural processing routine is carried out.

Figure 6:
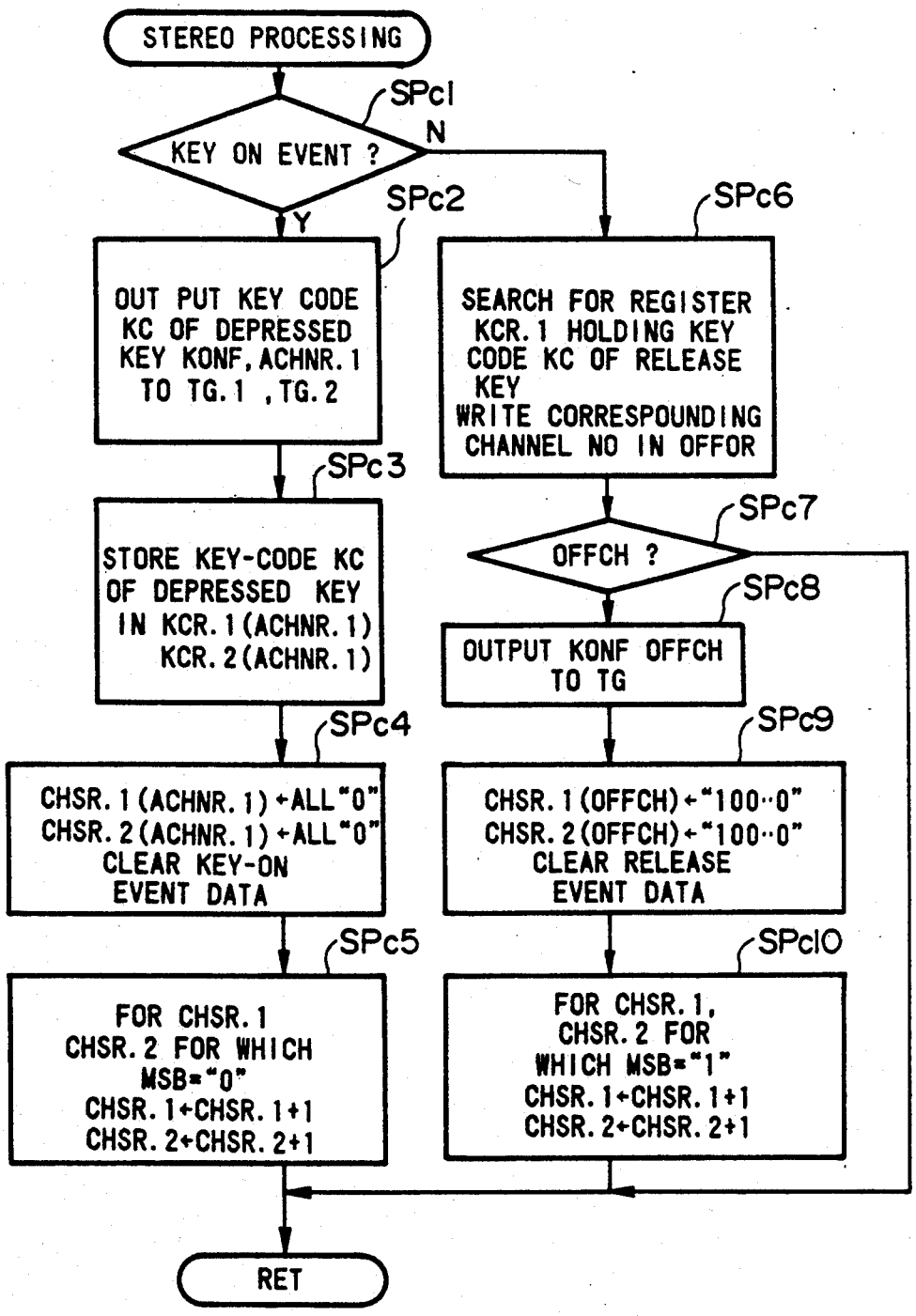

The above mentioned stereo processing routine is shown in the flow chart of FIG. 6. The above mentioned monaural processing routine is shown in the flow charts of FIGS. 7 through 9. Detailed descriptions of these routines will be deferred until a later section.

After completion of the above mentioned step SPa3, a value of "1" is written to a register CHN, and channel search processing is then carried out in steps SPa4 and SPa5. In the following step SPa6, the value held in a register C is written to register CHN, after which further channel search processing is carried out in steps SPa7 and SPa8. A value of "1" or "2" is stored in the register C referred to above during monaural processing routines, where a value of "1" indicates right tone generation systems and a value of "2" indicates left tone generation systems.

The channel search processing referred to above involves searching for the channel for tone generation which corresponds to a key for which a key-on event has occurred. This channel search processing will now be described in greater detail with reference to the flow chart of FIG. 5. First of all, in step SPb1, a value of "1" is written to a register PR. Register PR keeps a count which is essential for the channel search processing. Proceeding next to step SPb2, the value stored in register PR is written to register ACHNR1 when the value stored in register CHN is "1" or to register ACHNR2 when the value stored in register CHN is "2". In steps SPa4 and SPa7 in the flow chart of FIG. 4, a value of "1" or "2" is written to register CHN. During execution of the stereo processing routine of step SPa3 (hereafter stereo mode), the value stored in register PR, "1" in this case, is written to register ACHNR1. During execution of the monaural processing routine of step SPa6 (hereafter monaural mode), the value stored in register PR, again "1" in this case, is written to register ACHNR1 or register ACHNR2.

In step SPb2, as data necessary for channel search processing, the value stored in register CHSR[CHN]-[PR], where [CHN] represents the value stored in register CHN and [PR] represents the value stored in register PR, is written to temporary storage register ACHDR[CHN]. Thus, in stereo mode, the value stored in register CHSR1-1 is written to register ACHDR1, whereas in monaural mode, the value stored in register CHSR1-1 is written to register ACHDR1, or the value stored in register CHSR2-1 is written to register ACHDR2.

Next, in step SPb3, the value stored in register PR is incremented by 1, after which in step SPb4, judgement is made as to whether or not the value stored in register CHSR[CHN]-[PR] is greater than the value stored in register ACHDR[CHN]. Because the content of register CHSR[CHN]-1 was written to register ACHDR[CHN] in step SPb2, step SPb3 is in essence a comparison of register CHSR[CHN]-1 and register CHSR[CHN]-2. As above, the value stored in register CHN is a suitable value designated for the mode of operation in effect. When the result of the judgement step SPb4 is [YES], the routine proceeds to step SPa5, wherein the content of register PR is written to register ACHNR[CHN] and the content of register CHSR[CHN]-2 is written to register ACHDR[CHN], after which the routine proceeds to step SPb6. When the result of the judgement step SPb4 is [NO], processing jumps to directly to step SPb6, thereby skipping step SPb5.

In step SPb6, judgement is made as to whether or not the value stored in register PR is "8". When the result of this judgement is [NO], processing returns to step SPb3, after which the above described steps are cyclically repeated until the result of the judgement step SPb6 is [YES]. Thus, the judgement is step SPb4 is sequentially carried out for each of the eight channels.

Regarding the above described steps SPb4 and SPb5, during the processing involved in these steps, registers CHSR[CHN]-1 through CHSR[CHN]-8 are searched in order to identify which register holds the greatest value, after which the number of the identified register is stored in register CHSR[CHN] in step SPb5. When CHSR[CHN]-1 holds the greatest value, the value of "1" written to register ACHDR[CHN] in step SPb2 is left unchanged. During initialization, for each of registers CHSR[CHN]-1 through CHSR[CHN]-8, a value of "1" was written to each bit in each register. Further, when key-on events have been detected, for the channel employed for tone generation corresponding to the key-on event, a value of "0" is written to each bit in the register CHSR[CHN] for that channel, as is shown in the flow chart of FIG. 6. On the other hand, when key-off events have been detected, for the corresponding channel, a value of "1" is written to the high order bit and a value of "0" is written to each of the other bits in register CHSR[CHN] for that channel. Then, every time a key-on event is detected, each of registers CHSR[CHN]-1 through CHSR[CHN]-8 for which the high order bit has been set to "0" are simultaneously incremented, as is shown in the flow chart of FIG. 6 at step SPc5. Further, every time a key-off event is detected, each of registers CHSR[CHN]-1 through CHSR[CHN]-8 for which the high order bit has been set to "1" are simultaneously incremented, as is shown in the flow chart of FIG. 6 at step SPc10. Accordingly, for each of registers CHSR[CHN]-1 through CHSR[CHN]-8 associated with an earlier key-on event, to the extent that time has passed since the corresponding key-on event, the magnitude of the value stored in that register is great. Similarly, for each of registers CHSR[CHN]-1 through CHSR[CHN]-8 associated with an earlier key-off event, to the extent that time has passed since the corresponding key-off event, the magnitude of the value stored in that register is great. For a register associated with an earlier key-on event, and a register associated with an earlier key-off event, when the elapsed time is the same since the event to which each register corresponds, the register corresponding to the key-off event will hold the greater value of the two. Thus, during channel search, the channel number which has been written to register ACHNR1 or register ACHNR2 is the channel number for the channel corresponding to a key-off event having the highest priority, that is, the channel for which the corresponding key-off event has occurred least recently. On the other hand, when no channels corresponding to a key-off event are available, that is, when there are no open channels, the channel for which the longest period of time has elapsed since a key-on event has the highest priority. Accordingly, when the routine returns, having finished channel search processing, register ACHNR1 or register ACHNR2 holds the channel number of an open channel or of the channel for which the longest period of time has elapsed since a key-on event.

In stereo mode, channel search processing is carried out only for tone generation systems for which CHN equals 1, that is, only for the right sided tone generation systems. The reason being that, it is sufficient to search only the right or the left tone generation systems, since in stereo mode, for one key on the keyboard, tone generation channels having the same channel number in tone generator 10*a* and tone generator 10*b* are simultaneously utilized in parallel. In contrast, in monaural mode, either left sided or right sided tone generation systems are used alone, for which reason it is sufficient to search the designated side.

III. Key-on and Key-off Event Processing

In the following, key-on and key-off event processing for for stereo and for monaural mode will be described.

Stereo Mode

When a key event occurs when stereo switch 5*a* on control unit 5 is in the ON state, [YES] is judged in step SPa2 of the key event processing routine, whereupon the stereo processing routine shown in the flow chart of FIG. 6 is initiated.

First of all, in step SPc1, judgement is made as to whether or not the key event is a key-on event. When the result of this judgement is [YES], the routine proceeds to step SPc2, wherein the key-code KC of the key for which the key-on event has occurred, ON/OFF data KONF and the content of register ACHNR1 are transmitted to tone generators 10*a*, 10*b*. In this way, the tone generation channel designated in tone generator 10*a* and in tone generator 10*b* each generate a musical tone signal corresponding to the pitch of the key designated by the supplied key-code KC. These musical tone signals consist of waveform data, and each is supplied to a respective D/A converter 11*a*, 11*b* as shown in FIG. 2, wherein the digital signals are converted to corresponding analog signals, after which the analog signals are each supplied to a respective amplifier 16*a*, 16*b* via mixers 15*a*, 15*b*, wherein each signal is amplified and then supplied to the respective speakers 17*a*, 17*b* and output therefrom as audible stereo musical sound.

Next, in step SPc3, the above mentioned key-code KC of the key for which the key-on event has occurred is written to register KCR1-[ACHNR1] and register KCR2-[ACHNR1]. The value stored in register ACHNR1 is the value which was output from tone generators 10*a*, 10*b* in step SPc2. Next, in step SPc4, each bit in registers CHSR1-[ACHNR1] and CHSR2-[ACHNR1] is cleared to "0". Thus, at the onset of tone generation, the registers which will hold channel numbers are cleared. The routine then proceeds to step SPc5 wherein among registers CHSR1-1 through CHSR1-8 and registers CHSR2-1 through CHSR2-8, registers for which the high order bit is "0" are incremented by 1, after which the routine returns.

On the other hand, when the result of the judgement in step SPc1 is [NO], the routine proceeds to step SPc6, wherein registers KCR1-1 through KCR1-8 are searched for the key-code KC of the key for which the key-off event has occurred. In the processing of step SPc3 described above, the key-code KC corresponding to the key-on event was written to one of registers KCR1-1 through KCR1-8. The channel number of the channel corresponding to the register among registers KCR1-1 through KCR1-8 in which the key-code KC was located is then written to register OFFCH. Next, in step SPc7 judgement is made as to whether a channel number has been written to register OFFCH. When the result of this judgement is [NO], the routine returns, in which case, tone generation is terminated prior to further key-off processing, after which through the operation of an interrupt DF to be described later, all of the bits are set to "1" in the registers among registers KCR1-1 through KCR1-8 and registers KCR2-1 through KCR2-8 corresponding to the channel for which the key-off event occurred. In the case when all the bits are set to "1" in these registers, this pattern does not correspond to a key-code KC, but rather results in the registers not being identified in step SPc6.

When the result of the judgement in step SPc7 is [YES], the routine proceeds to step SPc8 wherein ON/-OFF data KONF and the channel number stored in register OFFCH are transmitted to tone generators 10*a*, 10*b*. As a result, tone generation in the tone generation channels previously designated in tone generator 10*a* and in tone generator 10*b* each is halted. The routine then proceeds to step SPc9 wherein the high order bit in registers CHSR1-[OFFCH] and CHSR2-[OFFCH] are set to "1" and the other bits are cleared to "0". Here, the value [OFFCH] is the channel number for halted tone generation channel. The routine then proceeds to step SPc10 wherein among registers CHSR1-1 through CHSR1-8 and registers CHSR2-1 through CHSR2-8, registers for which the high order bit is "1" are incremented by 1, after which the routine returns. By this incrementation, priority ranking for channel search processing is designated.

Figure 10:
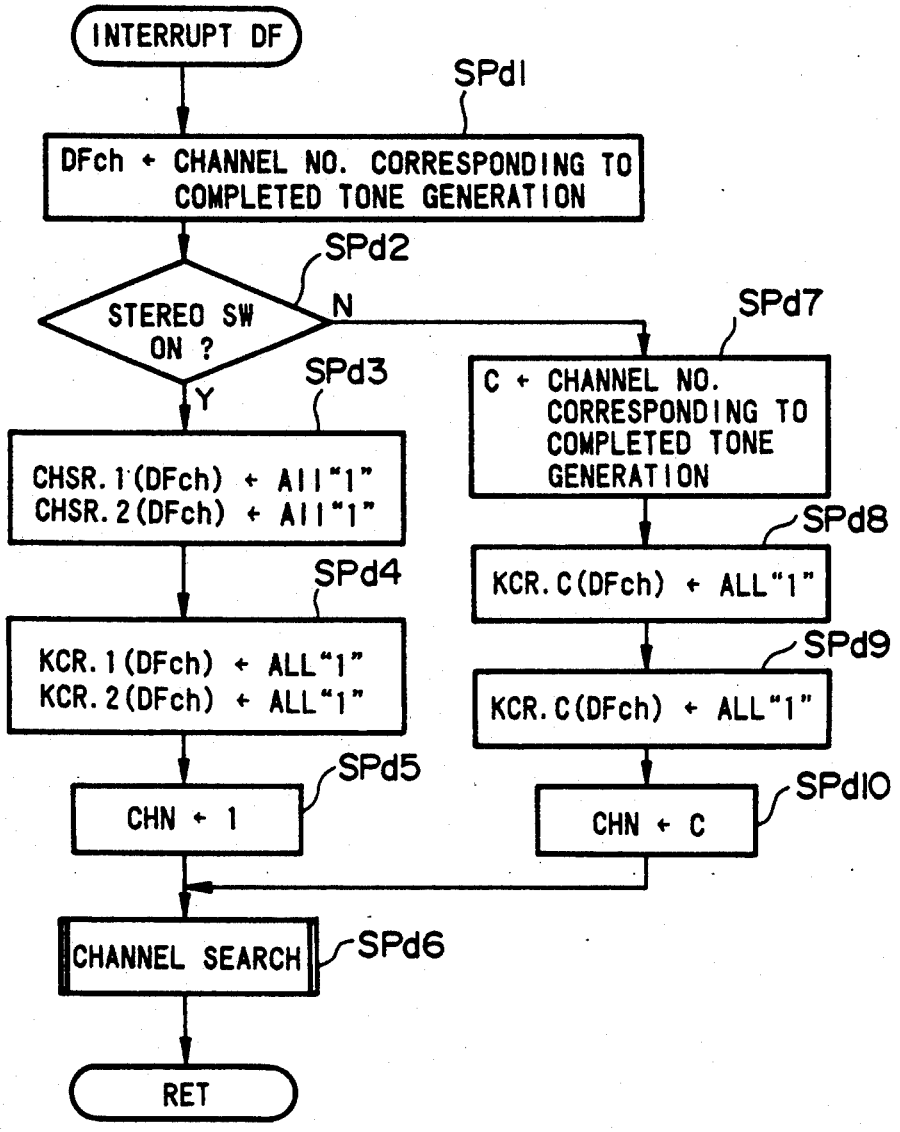

Referring to the flow chart of FIG. 10, interrupt DF processing will now be described. Interrupt DF processing is processing initiated by an interrupt when tone generation in a tone generation channel is halted. During this processing, termination of tone generation is not achieved by the key-off processing, but rather is effected through amplitude reduction by tone envelope processing, discussion of which is beyond the scope of the present document. With interrupt DF processing, first of all, the channel number of the channel for which tone generation is terminated is written to register DFch in step SPd1, after which judgement is made as to whether or not the stereo switch 5*a* is in the ON state in step SPd2. When the result of the judgement in step SPd2 is [YES], the routine proceeds to step SPd3 wherein all bits in registers CHSR1-[DFch] and CHSR2-[DFch] are set to "1". Next, in step SPd4, all bits in registers KCR1-[DFch] and KCR2-[DFch] are set to "1". In step SPd5, "1" written to register CHN and channel search processing is then carried out in step SPd6.

Figure 5:
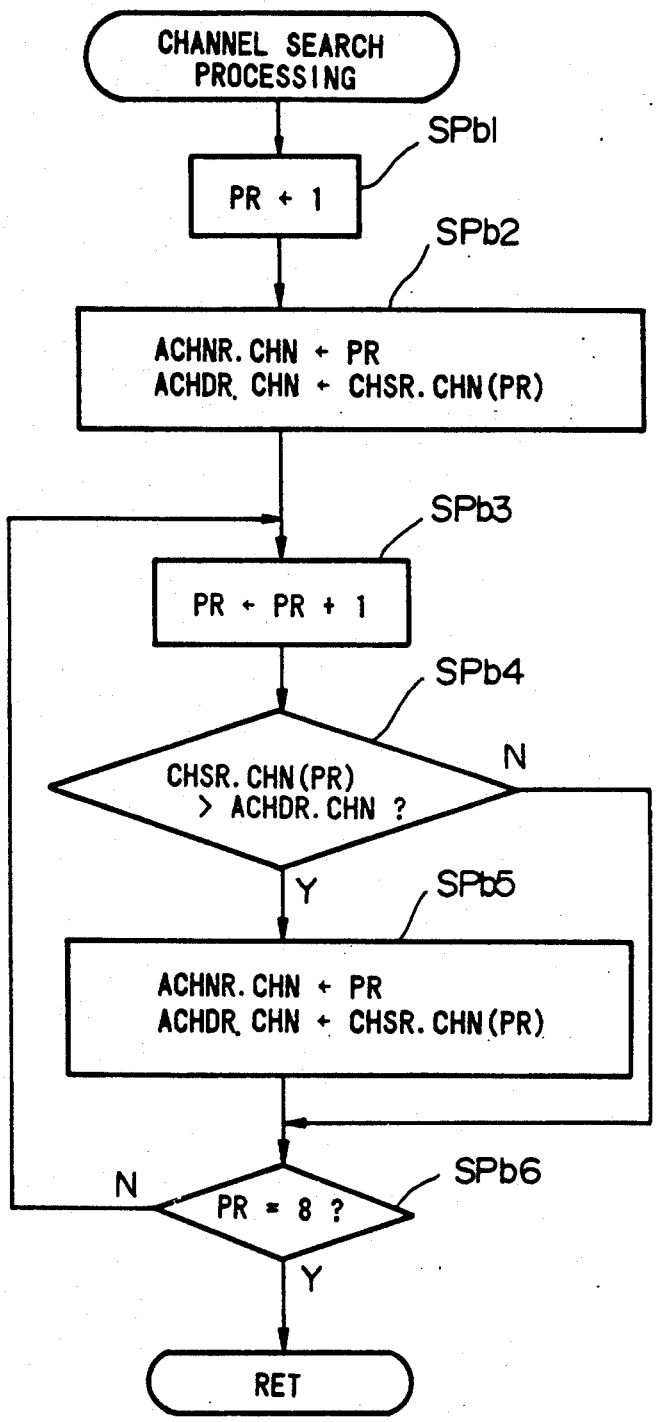

The channel search processing initiated in step SPd6 is the same as the previously described channel search processing shown in FIG. 5. However, in the case of interrupt DF processing, because all of the bits in registers CHSR1-[DFch] and CHSR2-[DFch] are set to "1" in step SPd3, the tone generation channel corresponding to the channel number stored in register DFch has the highest priority, thus this channel number is written in register ACHNR[CHN], whereupon processing returns to the main routine. This is because the channel for which tone generation is terminated becomes an open channel, for which reason the same channel can safely be used for the next key-on channel, thus expediting processing.

When the result of the judgement in step SPd2 is NO, the processing jumps to step SPd7 wherein the number of the tone generation system for which tone generation was terminated, that is, [1] for a right sided the tone generation system or [2] for a left sided the tone generation system, is stored in register C. Next, in step SPd8, all bits in register CHSR[C]-[DFch] are set to "1", after which the routine proceeds to step SPd9, wherein all bits in register KCR[C]-DFch] are set to "1". The processing in steps SPd8 and SPd9 is the same as that of steps SPd3 and SPd4. Processing in monaural mode differs in that processing is carried out only for the tone generation system for which tone generation has been terminated. In step SPd10, the value stored in register C is written to register CHN, after which the processing jumps to step SPd6 wherein channel search processing is carried out, which is identical to that described above.

Monaural Mode

Figure 7:
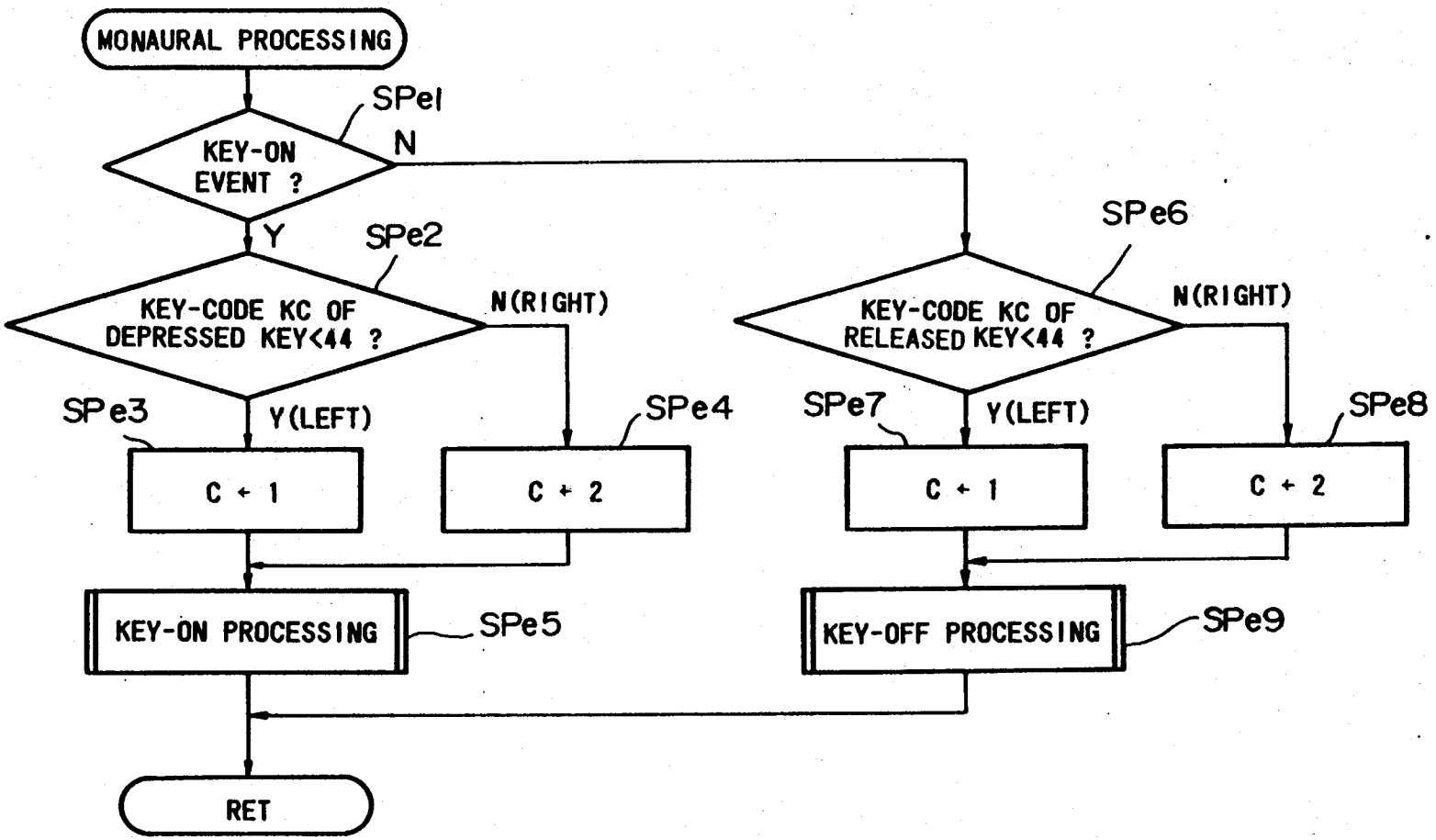
Figure 8:
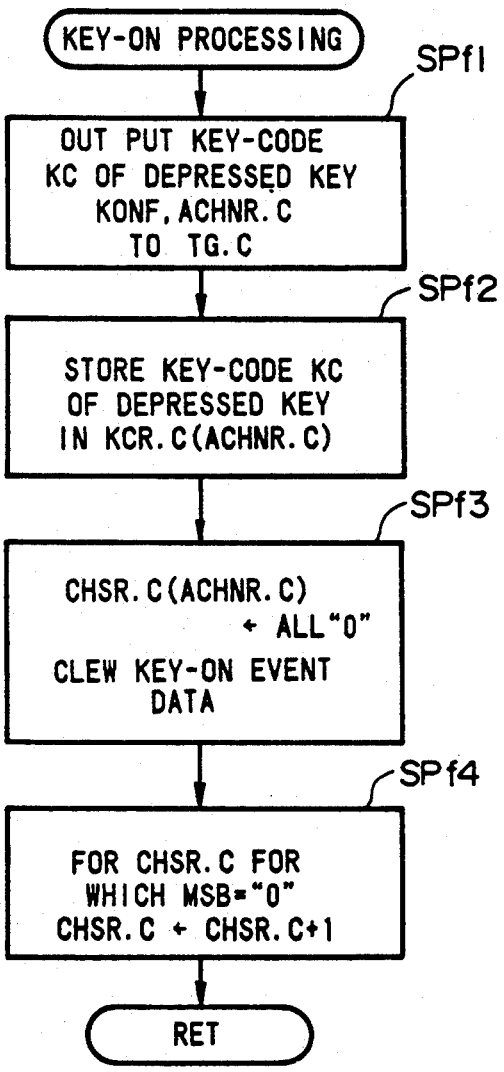
Figure 9:
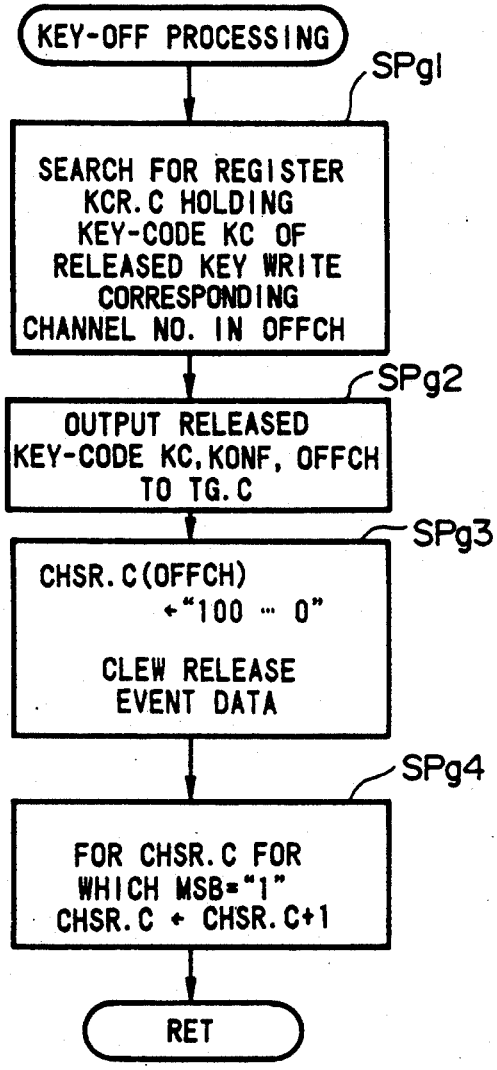

When a key event occurs when stereo switch 5*a* on control unit 5 is in the OFF state, [NO] is judged in step SPa2 of the key event processing routine, whereupon the monaural processing routine shown in the flow chart of FIG. 7 is initiated.

First of all, in step SPe1, judgement is made as to whether or not the key event is a key-on event. When the result of this judgement is [YES], the routine proceeds to step SPe2, wherein judgement is made as to whether or not the key-code KC of the key for which the key-on event has occurred is smaller than [44], this key-code corresponding to the key-code KC of the center key. If the judgement in step SPe2 is [YES], thus indicating a key-on event corresponding to a key on the lower half of the keyboard (low tone division), the routine proceeds to step SPe3 wherein a value of "1" is written to register C, whereas if the judgement in step SPe2 is [NO], thus indicating a key-on event corresponding to a key on the upper half of the keyboard (high tone division), the routine jumps to step SPe4 wherein a value of "2" is written to register C.

After completion of step SPe3 or step SPe4, the routine proceeds to step SPe5 wherein key-on event processing is carried out. This key-on event processing is that shown in steps SPf1 through SPf4 in the flow chart of FIG. 8, and generally the same as the previously described key-on event processing shown in steps SPe2 through SPe5 in the flow chart of FIG. 6. In the case of steps SPf1 through SPf4 in FIG. 8, key-on event processing is carried out for either a right sided tone generation system or a left sided tone generation system, but not both. The reason being that in monaural mode, tone generation is carried out in only one of tone generators 10*a*, 10*b*. For example, when the key-on event relates to a key on the lower half of the keyboard, that is, when the result of the judgement in step SPe2 is [YES], in the processing of step SPf1, the key-code KC, ON/OFF data KONF and the content of register ACHNR1 are transmitted to only tone generator 10*a*, for which reason only tone generator 10*a* outputs a musical tone signal corresponding to the pitch of the key designated by the key-code KC supplied thereto.

In this case, CPU 1 supplies a control signal to gates 12*a* and 12*b*, whereby the gates open. As a result, after the musical tone signal output from tone generator 10*a* is supplied to D/A converter 11*a* shown in FIG. 2 and output therefrom as the corresponding analog signal, this signal is supplied to both of mixers 15*a*, 15*b* via the open gates 12*a*, 12*b*, and then to amplifiers 16*a*, 16*b* wherein the signal is amplified and then supplied to speakers 17*a*, 17*b* and output therefrom as audible monaural musical sound.

In the case of monaural processing, tone generator 10*a* handles tone generation for activity of keys on the lower half of the keyboard, whereas tone generator 10*b* handles tone generation for activity of keys on the upper half of the keyboard. As a result, the eight tone generation channels of tone generator 10*a* and the eight tone generation channels of tone generator 10*b* can be used independently for a total of sixteen tone generation channels.

When a key-off event has occurred and the result of the judgement in step SPe1 is therefore [NO], the routine proceeds to step SPe6, and then to step SPe7 or step SPe8. After completion of step SPe7 or SPe8, the routine then proceeds to step SPe9 wherein key-off event processing is carried out. The processing in steps SPe6, SPe7 and SPe8 is the same as the previously described processing in steps SPe2, SPe3 and SPe4. The key-off event processing of SPe9 is made up of steps SPg1 through SPg4 shown in the flow chart of FIG. 9, which is generally the same as the previously described processing that takes place in steps SPc6, SPc8, SPc9 and SPc10 in the flow chart of FIG. 6. In the case of processing in monaural mode, however, the processing differs in that key-off event processing is carried out only for the tone generation system for which tone generation has been terminated.

Numerous variations in the structure and function of the electronic musical instrument of this first preferred embodiment of the present invention as described above are possible. In the following, several of these variations will be briefly described.

1. Although described above as having two tone generating systems, three or more such systems can be provided to further enhance the effect of the present invention.
2. Many variations of the circuitry layout are possible. As one example, the mixers can be digital mixers which are before the D/A converters in the circuit path.
3. A keyboard was employed as the input device in the above preferred embodiment, however many other possibilities exist. As is shown in FIG. 1, a bi-directional MIDI interface (musical instrument digital interface) can be employed, for example, interposed between the device of the present invention and one or more other external input devices, including, but not limited to, keyboards. Additionally, input means which supply woodwind or brass instrument-like input signals, as well as automatic performance devices can be suitably employed.
4. In the case of monaural mode operation when a keyboard input device is employed, the left and right channel allocation need not be based on a division at the key for which the key-code KC is [44], and other and multiple breakpoints can be employed. Additionally, rather than only pitch, allocation to a channel can be based on one or more other parameters instead of or in addition to pitch, for example, timbre or various other parameters. Moreover, tone generation in monaural mode can always be allocated to the same tone generation system if desirable.
5. In addition to waveform data based tone generation, other tone generation means such as frequency modulation type tone generation can be suitable employed.
6. The invention can be implemented with a single tone generator and D/A converter, utilizing time slicing or other methods to provide complex signals over a single channel.
7. The present invention has been described such that when in monaural mode, the eight tone generation channels corresponding to the upper half of the keyboard and the eight tone generation channels corresponding to the lower half of the keyboard can simultaneously generate tones, although with the described structure, it is not possible to allocate the total sixteen tone generation channels to the upper half of the keyboard only or the lower half of the keyboard only. However, by modifying tone generators 10*a* and 10*b* so that by time slicing, sixteen tone generation channels can simultaneously generate tones, tone generation by any or all of the tone generation channels can be designated by the operation of any key. When such a modification is carried out, in stereo mode, two channels can be made to operate as a pair, thereby achieving stereo tone generation.
8. Although the instrument has been described such that each tone generating system can simultaneously generate eight tones, the tone generating systems can be designed such that only one tone is generated by one tone generating system at a time.

9. Multiple memory elements for storing musical tone waveform data can be provided together with multiple musical tone signal generating systems, whereby tone generation corresponding to data in each memory element can be simultaneously carried out. In such a case, the instrument can be designed such that, in monaural mode, the data of one memory element is allocated to multiple tone signal generating systems, and in stereo mode, the data of each memory element is allocated to a different tone signal generating system. Further, the instrument can be designed such that performance data output from a keyboard or the like is supplied in common to all tone signal generating system.

10. Electronic rhythm devices can also be incorporated in the present invention. In such a case, when a timbre such as that of a tambourine is designated, in order to generate the tones corresponding to the drum component and the bell component of the tambourine sound, by causing the left and right channel tone generating systems to each generate one of the two tones, a unique effect can be achieved. Similar effects can be achieved for snare drums and the like.

What is claimed is:

1. An electronic musical instrument comprising:

a) performance data generating means for generating performance data;

b) multiple musical tone generating systems for producing musical tone signals in response to said performance data;

c) multiple musical sound producing systems to which said musical tone signals are supplied and which produce musical sound in response to said musical tone signals;

d) mode indicating means for indicating:

i) a first mode wherein musical sound is generated in response to operation of one of said musical tone generating systems, ii) a second mode wherein musical sound is generated in response to operation of at least two musical tone generating systems;

e) selections means for:

i) allocating the performance data output from said performance data generating means to a single musical tone generating system when the mode indicated by said mode indicating means is said first mode, ii) allocating the performance data output from said performance data generating means to each of said multiple musical tone generating systems when the mode indicated by said mode indicating means is said second mode;

f) distribution means for:

i) supplying to at least one of said multiple musical sound producing systems the musical tone signal output from the signal musical tone generating system to which said performance data is allocated when the mode indicated by the mode indicating means is said first mode, ii) supplying to each of said multiple musical sound producing systems the musical tone signal output from a corresponding musical tone generating system when the mode indicated said mode indicating means is said second mode, such that each musical tone signal is supplied to a difference musical sound producing system.

2. An electronic musical instrument comprising:

a) performance data generating means for generating performance data;

b) multiple musical tone generating systems for producing musical tone signals in response to said performance data;

c) multiple musical sound producing systems to which said musical tone signals are supplied and which produce musical sound in response to said musical tone signals;

d) mode indicating means for indicating:

i) a first mode wherein each of said multiple musical sound producing systems generates the same musical sound, ii) a second mode wherein each of said multiple musical sound producing systems generates different musical sound;

e) selection means for:

i) allocating the performance data output from said performance data generating means to multiple groups on the basis of a predetermined standard when the mode indicated by said mode indicating means is said first mode, and supplying the performance data allocated to a respective group is then supplied to at least one respective corresponding musical tone generating system, the correspondence between groups and musical tone generating system having been determined on a predetermined basis, ii) allocating the performance data output from said performance data generating means to each of said multiple musical tone generating systems when the mode indicated by said mode indicating means is said second mode;

f) distribution means for:

i) supplying to each musical sound producing system the musical tone signals output from all of the musical tone generating systems when the mode indicated by the mode indicating means is said first mode, ii) supplying to each musical sound producing system the musical tone signal output from a corresponding musical tone generating system when the mode indicated by said mode indicating means is said second mode, such that each musical tone signal is supplied to a different musical sound producing system.

3. An electronic musical instrument in accordance with either of claims 1 and 2, wherein said multiple musical tone generating systems comprise time splicing means for time slicing the performance data output from the performance data generating means.

4. An electronic musical instrument in accordance with either of claims 1 and 2, further comprising waveform data memory means for storing predetermined waveform data, wherein said musical tone signals output from said multiple musical tone generating systems are produced by reading out said predetermined waveform data.

5. An electronic musical instrument in accordance with either of claims 1 and 2, wherein said multiple musical tone generating systems include a frequency modulation type tone synthesizer for producing said musical tone signals.

6. An electronic musical instrument in accordance with claim 2, wherein said performance date generating means comprises a keyboard having a plurality of keys, said groups being set so as to correspond to at least one predetermined key position.

7. An electronic musical instrument in accordance with claim 6, including comparison means for comparing a key position with a reference key position when the mode indicated by said mode indicating means is said first mode, said selection means allocating the performance data to one of said musical tone generating systems based on said comparison.

8. An electronic musical instrument in accordance with either of claims 1 and 2, including comparison means for comparing a pitch to be generated with a reference pitch when the mode indicated by said mode indication means is said first mode, said selection means allocating the performance data to one of said musical tone generating systems based on said comparison.

9. An electronic musical instrument in accordance with either of claims 1 and 2, including timbre generation means for generating a timbre when the mode indicated by said mode indicating means is said first mode, said selecting means allocating the performance data to one of said musical tone generating systems based on said comparison.

10. An electronic musical instrument comprising:

a) performance date generating means for outputting performance data which corresponds to a musical performance;

b) tone data memory means for storing tone data representing a plurality of waveforms corresponding to musical tones;

c) multiple musical tone signal generating systems for producing musical tone signals in response to said tone data and said performance data;

d) mode indicating means for indicating:

i) a first mode wherein musical sound is generated in response to musical tone data representing a waveform which corresponds to one musical tone, ii) a second mode wherein musical sound is generated in response to musical tone data representing waveforms which corresponds to at least two musical tones, e) allocation means for allocating said performance data output from said performance data generating means to each musical tone signal generating system, said allocating means allocating a single musical tone datum among said tone data to each musical tone signal generating system when the mode indicated by said mode indicating means is said first mode, said allocating means allocating a different musical tone datum among said tone data to each musical tone signal generating system when the mode indicated by said mode indicating means is said second mode.

11. An electronic musical instrument in accordance with claim 10, wherein said multiple musical tone signal generating systems comprises time splicing means for time slicing the performance data and the tone data.

12. An electronic musical instrument in accordance with claim 10 above, wherein said performance data generating means comprises a keyboard.

13. An electronic musical instrument in accordance with claim 10 above, wherein said performance data generating means comprises an external device which communicates with said electronic musical instrument through a MIDI format interface.

14. An electronic musical instrument comprising:

a) a plurality of musical tone signal generating means, each of which generates a musical tone signal;

b) a plurality of sound producing means, each of which produces musical sound in response to said musical tone signal;

c) mode selecting means for selecting one of a first mode and a second mode;

d) selecting means for selecting one of said plurality of tone signal generating means when said first mode is selected, wherein at least one of said plurality of sound producing means produces a musical tone in response to a musical tone signal generated by said musical tone signal generating means selected by said selecting means; and e) distributing means for distributing musical tone signals generated by said plurality of musical tone signal generating means to respective sound producing means of said plurality of sound producing means when said second mode is selected.

15. An electronic musical instrument in accordance with claim 14, further comprising a keyboard having a plurality of keys, each of said plurality of keys having corresponding performance data including corresponding pitch data assigned thereto, wherein operation of any of said keys results in generation of said corresponding performance data, said plurality of musical tone signal generating means generating musical tone signals in response to said performance data, and wherein said selecting means selects one of said plurality of musical tone signal generating means based on said pitch data when said first mode is selected.

16. An electronic musical instrument in accordance with claim 15 wherein said selecting means includes reference pitch data memory means for storing reference pitch data, and wherein said selecting means selects at least one of said musical tone signal generating means on the basis of said pitch data and said reference pitch data.

17. An electronic musical instrument comprising:

a) memory means for storing waveform data including a plurality of waveform data components;

b) a plurality of musical tone signal generating means, each of which generates a musical tone signal in response to a waveform data component from said waveform data;

c) mode selecting means for selecting a first operating mode or a second operating mode; and d) assigning means for assigning waveform data, wherein said assigning means assigns a waveform data component from among said waveform data to at least one of said plurality of musical tone signal generation means when said first mode is selected, and assigns at least two waveform data components from said waveform data to respective musical tone signal generating means when said second mode is selected.

18. An electronic musical instrument in accordance with claim 17 including designating means for designating each of said plurality of waveform data components and each of said plurality of musical tone signal generating means to correspond to at least one of a left channel and a right channel, wherein said assigning means respectively assigns waveform data components designated to correspond to one of said left channel and said right channel, respectively, to musical tone signal generating means which have been designated to correspond to said left channel and said right channel.

19. An electronic musical instrument in accordance with claim 17 further comprising a keyboard having a plurality of keys, each of said plurality of keys having corresponding performance data including corresponding pitch data associated therewith, wherein operation of any of said plurality of keys results in generation of corresponding performance data, wherein said plurality of musical tone signal generating means generate musical tone signals in response to said performance data, and wherein said assigning means assigns one of said waveform data components to at least one of said plurality of musical tone signal generating means based on said pitch data when said first mode is selected.

20. An electronic musical instrument in accordance with claim 19 including reference pitch data memory means for storing reference pitch data and comparison means for comparing said pitch data with said reference pitch data, wherein said selecting means selects said musical tone signal generating means on the basis of said comparison of said pitch data with said designated reference pitch data.

21. An electronic musical instrument according to claim 17, further comprising a plurality of sound producing means for producing musical sounds in response to said musical tone signals produced by said plurality of musical tone signal generating means.

22. An electronic musical instrument comprising:

a) a plurality of musical tone signal generators, each of which generates at least one musical tone signal;

b) a plurality of sound producing devices, each of which produces musical sound in response to a musical tone signal generated by said musical tone signal generators;

c) mode selection means for selecting one of a first mode and a second mode;

d) signal generator selecting means for selecting only one of said plurality of musical tone signal generators when said first mode is selected, wherein at least one of said plurality of sound producing devices produces a musical tone in response to a musical tone signal generated by said selected musical tone signal generator; and e) distributing means for distributing at least two different musical tone signals generated by said plurality of musical tone signal generators to at least two respective sound producing devices of said plurality of sound producing devices when said second mode is selected.

23. An electronic musical instrument according to claim 22, wherein said first mode is a monaural sound reproduction mode.

24. An electronic musical instrument according to claim 22, wherein said second mode is a stereo sound reproduction mode.

25. An electronic musical instrument comprising:

first generating means for generating a first musical tone signal;

second generating means for generating a second musical tone signal different from said first musical tone signal;

first producing means for producing a musical sound in response to a musical tone signal inputted thereto;

second producing means for producing a musical sound in response to a musical tone signal inputted thereto;

mode selecting means for selecting a first mode or a second mode from among a plurality of modes; and assigning means, (1) when said first mode is selected, for assigning said first musical tone signal to at least one of said first producing means and said second producing means, said first producing means producing a first musical sound in response to said first musical tone signal if said first musical tone signal is assigned thereto and said second producing means producing a second musical sound in response to said first musical tone signal if said first musical tone signal is assigned thereto, and (2) when said second mode is selected, for assigning said first musical tone signal to said fist producing means, said first producing means producing said first sound in response to said first musical tone signal, and for assigning said second musical tone signal to said second producing means, said second producing means producing a second sound in response to said second musical tone signal.

* * * * *